US006435574B1

(12) United States Patent
Taga et al.

(10) Patent No.: US 6,435,574 B1
(45) Date of Patent: Aug. 20, 2002

(54) LOCK DEVICE OF AUTOMOBILE OPENABLE BODY

(75) Inventors: Shigenori Taga; Katsumi Nakagome, both of Yokohama (JP)

(73) Assignee: Ohi Seisakusho Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/542,650

(22) Filed: Apr. 4, 2000

(30) Foreign Application Priority Data

Apr. 30, 1999 (JP) ..... 11-124720

(51) Int. Cl.[7] ..... E05C 3/06
(52) U.S. Cl. ..... 292/216; 292/DIG. 23
(58) Field of Search ..... 292/DIG. 23, DIG. 14, 292/216, 169.11; 70/432

(56) References Cited

U.S. PATENT DOCUMENTS 4,968,074 A * 11/1990 Yamagishi et al. ..... 292/201
5,064,229 A * 11/1991 Hamada et al. ..... 292/216
5,516,164 A * 5/1996 Kobayashi ..... 292/201
5,516,167 A * 5/1996 Hayakawa et al. ..... 292/337
5,618,068 A * 4/1997 Mitsui et al. ..... 292/201
5,632,120 A * 5/1997 Shigematsu et al. ..... 49/449
6,048,003 A * 4/2000 Shimura ..... 292/216
6,059,328 A * 5/2000 Gomi ..... 292/216
6,116,664 A * 9/2000 Wegner ..... 292/216
6,168,216 B1 * 1/2001 Nakajima et al. ..... 292/201
6,264,253 B1 * 7/2001 Takaishi ..... 292/216

FOREIGN PATENT DOCUMENTS

JP 3-47084 10/1991

* cited by examiner

*Primary Examiner*—Paul N. Dickson
*Assistant Examiner*—Devon Kramer
(74) *Attorney, Agent, or Firm*—Kilpatrick Stockton, LLP

(57) ABSTRACT

The lock device has a latch which is interposed between a base member and a reinforcing plate and is for rotating between an engagement position and an engagement released position. The engagement position is where the latch is to be engaged with a striker when closing an openable body. In addition, the lock device has a locking lever for constraining the latch at the engagement position. The latch by a latch shaft and the locking lever by a lever shaft each are mounted to a back side of the base member with the reinforcing plate. While the reinforcing plate is provided with a projection for fixing engagement which projects toward inside as seen from outside. The projection for fixing engagement fixes a detecting switch to be supported for detecting movement of the latch by fitting in a fitting portion provided to a switch body of the detecting switch.

11 Claims, 5 Drawing Sheets

LOCK DEVICE OF AUTOMOBILE OPENABLE BODY

BACKGROUND OF THE INVENTION

1. Field of the Invention

The present invention relates to a lock device of an automobile openable body that is suitable to a hood of an automobile.

2. Description of Relevant Art

The automobile hood is provided with detecting means for detecting that the hood is being opened by using biasing means as disclosed in Japanese Utility Model Publication No. 3-47084, for example.

In a schematic structure of the detecting means, a separately-formed bracket is mounted to a base member that is a base of a lock device. When the constrained locking lever is brought into a constraint released state by using the biasing means, a detecting switch detects movement of a locking lever and a signal is transmitted to an alarm device.

SUMMARY OF THE INVENTION

Since the detecting switch for transmitting the signal to the alarm device is mounted to the base member that is the base of the lock device through the bracket, the detecting switch requires special space for mounting. Therefore, the device as a whole occupies large space, and is not desirable in terms of a mounting degree of freedom. The device makes a mounting operation take a lot of time and operations in an engine room where it is difficult to find space for the operation due to existence of respective auxiliaries.

Therefore, it is an object of the present invention to provide a lock device of an automobile openable body that is excellently burglarproof.

It is another object of the invention to provide a lock device which does not occupy large space.

It is another object of the invention to provide a lock device which can be assembled easily.

It is another object of the invention to provide a lock device which has remarkably preferable strength and rigidity.

To achieve the objects, a first aspect of the invention is provided with a lock device for an openable body of an automobile. The lock device has a latch which is interposed between a base member and a reinforcing plate and is for rotating between an engagement position and an engagement released position. The engagement position is where the latch is to be engaged with a striker when closing an openable body. In addition, the lock device has a locking lever for constraining the latch at the engagement position. The latch by a latch shaft and the locking lever by a lever shaft each are mounted to a back side of the base member with the reinforcing plate. While the reinforcing plate is provided with a projection for fixing engagement which projects toward inside as seen from outside. The projection for fixing engagement fixes a detecting switch to be supported for detecting movement of the latch by fitting in a fitting portion provided to a switch body of the detecting switch.

Preferably, the projection for fixing engagement and the fitting portion have two-point supported fitting structures.

Preferably, at least one of two-point supported projections for fixing engagement is formed on a plate-like projecting piece which is formed integrally out of a reinforcing plate to be bent and has an opening. While a fitting portion has an enlargable C-shape in which one side to be fitted with the projecting piece is open, and has a stopper for preventing dropping which detachably engages with the opening.

Preferably, one of the two-point supported projections for fixing engagement is formed integrally out of the reinforcing plate to be bent and has a hook portion. While a fitting portion has a resiliently deformable hole-shape in which a two elongated holes with a width size smaller than that of the hook portion of the projecting piece partially overlap.

Preferably, the detecting switch is positioned in a back area of the base member with a wire extending from the detecting switch, and has an arrangement structure which makes the detecting switch not be seen from outside.

Preferably, the detecting switch comprises a switch body which has a fitting portion to be fitted with a projection for fixing engagement and a detecting lever which is rotatably supported to a switch body. The detecting lever detachably engages with an engagement hole of the latch and is arranged between the switch body and the reinforcing plate.

A second aspect of the invention is provided with a lock device for an openable body of an automobile. The lock device has a rotatable latch; a detecting switch which is for detecting a position of the latch and has a fitting portion; and a projection which is fitted with the fitting portion to fix the detecting switch.

Preferably, the lock device further has a base member which is opposed to the detecting switch relative to the latch.

Preferably, the lock device further has a reinforcing member which is interposed between the detecting switch and the latch and is fixed with the projection.

Preferably, the lock device further has a locking lever for lockingly engaging with the latch. The reinforcing member is opposed to the base member relative to the locking lever.

Preferably, the projection has an opening. The fitting portion is fitted in the projection. The fitting portion has an enlargable holding portion having an opening portion and a stopper portion which latches with the opening of the projection.

Preferably, the projection has a hook portion which passes through the fitting portion to be locked, and the fitting portion has a pair of elongated holes which partially overlap and are resiliently deformable.

Preferably, the detecting switch has a wire which extends on an opposite side to the base member.

Preferably, the detecting switch has a detecting lever which is engaged in the latch and is supported to rotate.

According to the above aspects of the invention, a detecting switch is fixed and supported by fitting portions with projections. Therefore, amounting operation of the detecting switch can be swiftly and easily completed, so that operability can be improved without being influenced by respective auxiliaries in an engine room.

The detecting switch and the wire are hidden by a base member and cannot be seen directly. Therefore, the wire for transmitting a signal to an alarm device cannot be cut, even when the device is attacked by fraudulent means. In addition, the detecting switch is housed in a base member and does not occupy large space. As a result, the base member and the reinforcing plate make strength and rigidity of the entire device increased.

In fitting of the projection and the fitting portion with each other, a size of the fitting portion is enlarged such that the projection and the fitting portion are to be easily fitted with each other. Since an opening engages with a stopper when fitting is completed, movement in a dropping direction is reliably constrained.

When the projection is forcedly fitted with the fitting portion, the fitting portion is resiliently deformed. After passing through the fitting portion without a hitch, a hook portion engages with an edge of the fitting portion, thereby obtaining a reliable fitted state in which movement in the dropping direction is restricted.

Even when the device is attacked by fraudulent means, the base member obstructs such attack and the lead wires for transmitting the signal to the alarm device is not to be cut, for example.

A detecting lever of the detecting switch is protected by a switch body and the reinforcing plate and reliably moves synchronously with a latch, thereby achieving accurate detection.

Since the detecting switch is fixed and supported at two points, the detecting switch can be mounted stably and reliably and accurate detection synchronous with the latch is obtained.

BRIEF DESCRIPTION OF THE ACCOMPANYING DRAWINGS

DETAILED DESCRIPTION OF THE PREFERRED EMBODIMENTS

Embodiments of the present invention will be described in detail below by reference to FIGS. 1 to 5.

Figure 1:
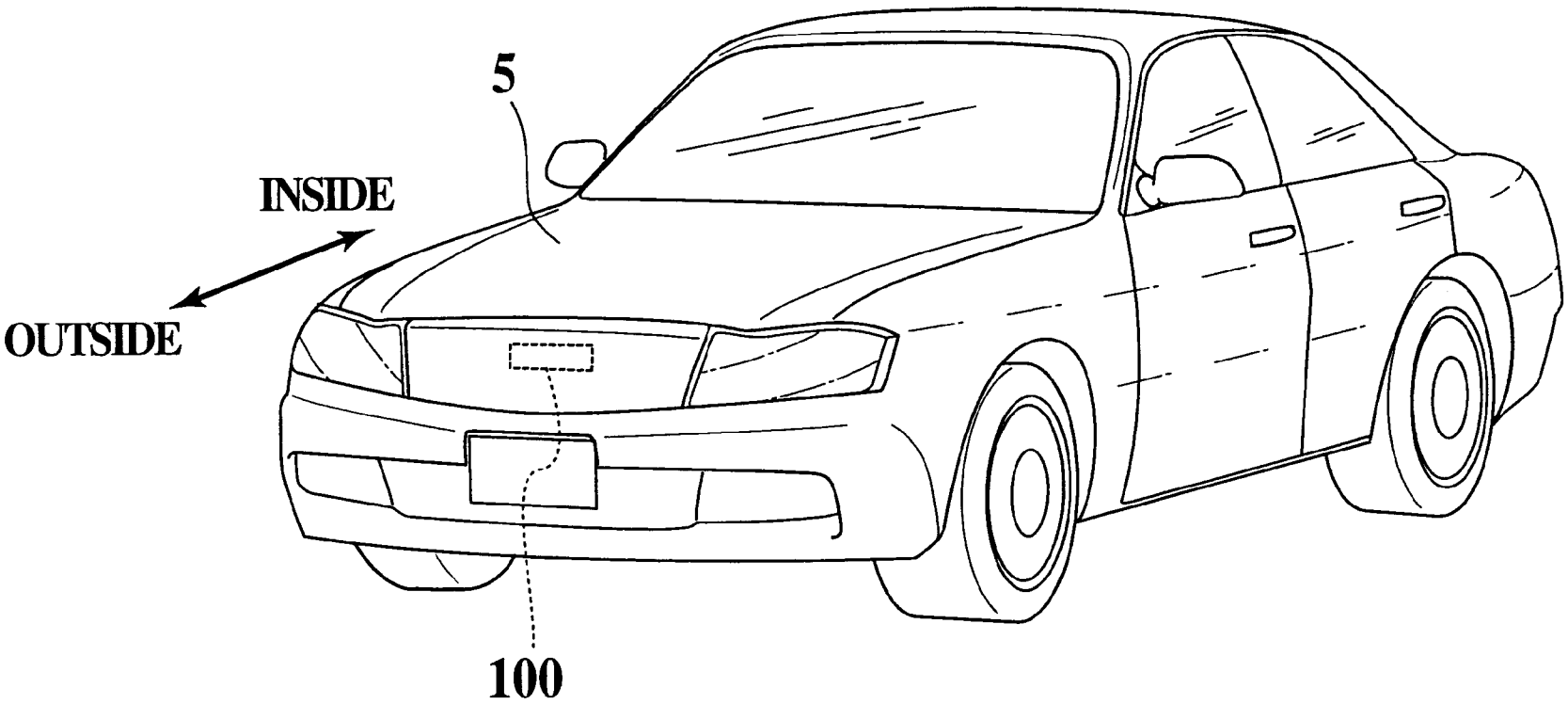
FIG. 1 is a conceptual illustration showing a lock device according to the present invention and mounted in an engine room.

As shown in FIG. 1, a lock device 100 is provided within an engine room and locks a hood 5.

Figure 2:
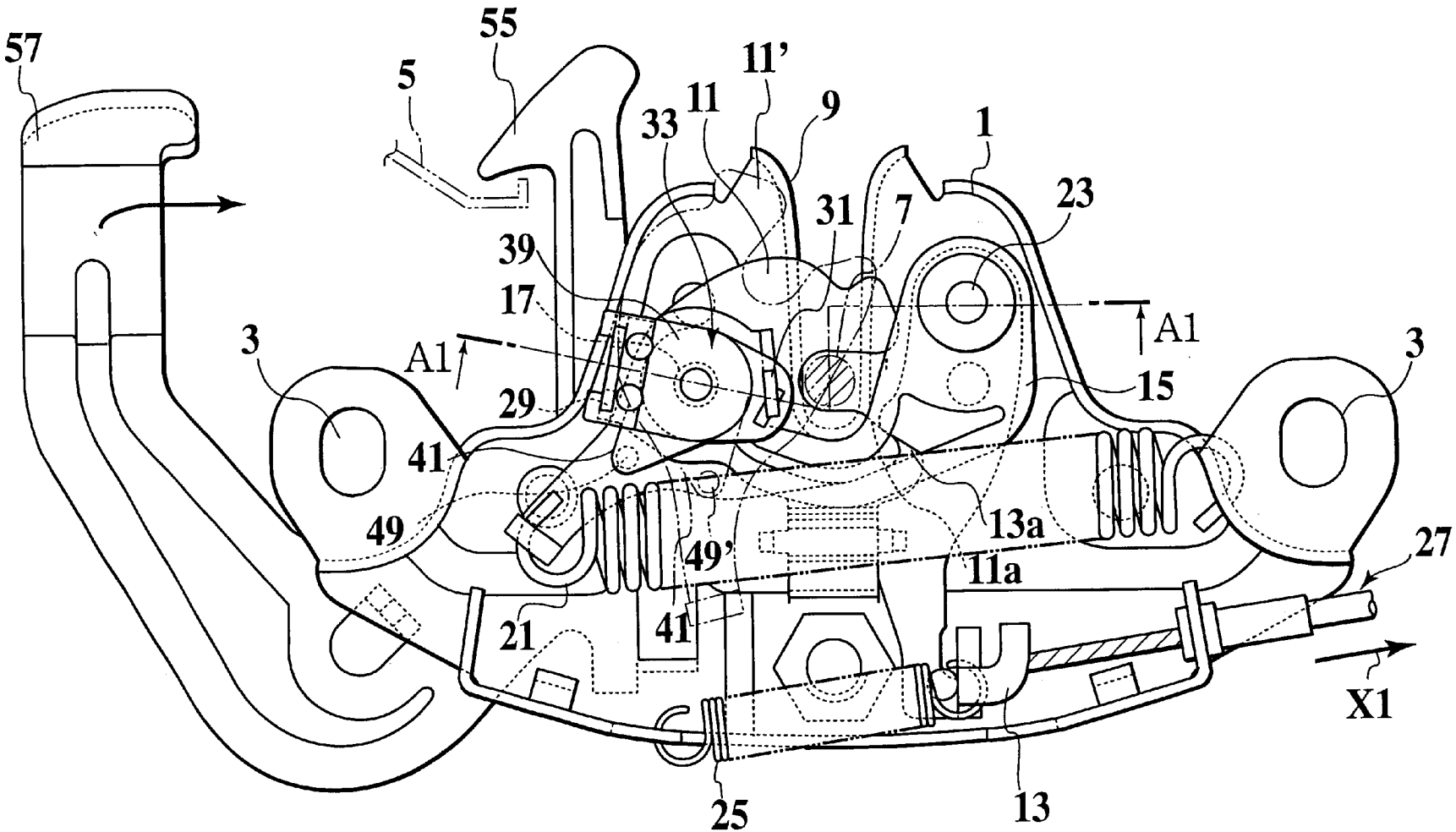
FIG. 2 is a back view of the lock device of the invention seen from an engine room side.
Figure 3:
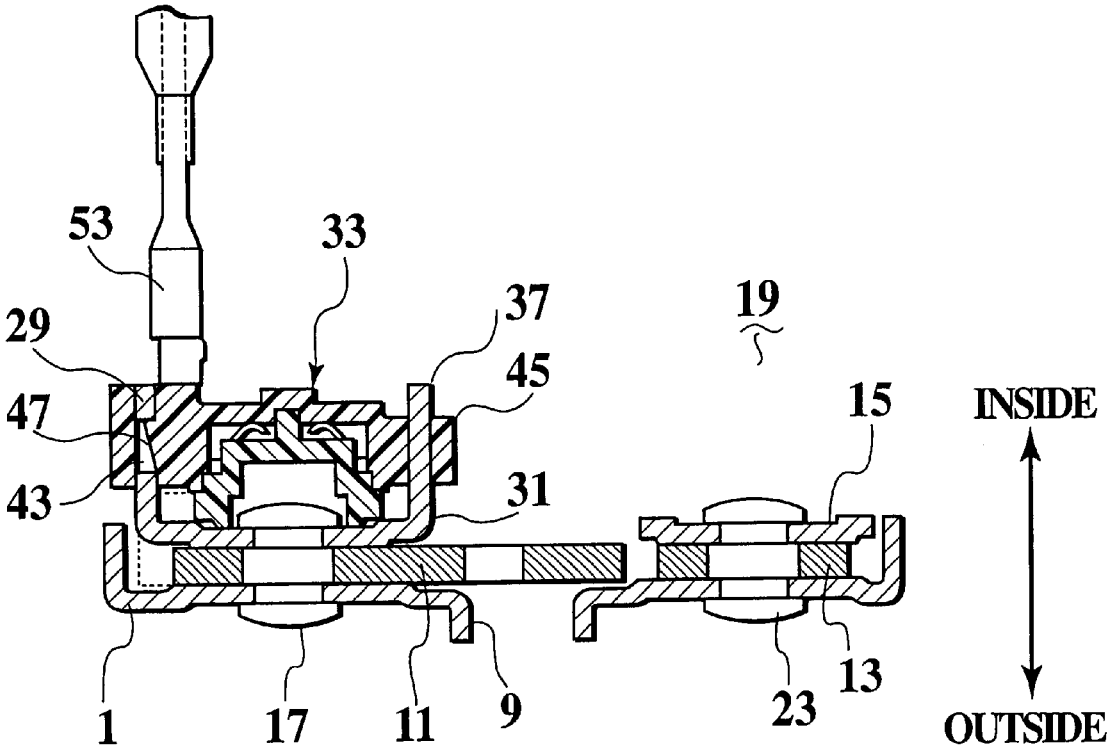
FIG. 3 is a sectional view taken along a line A1—A1 in FIG. 1.

FIG. 2 is a back view of the device seen from an engine room side. The lock device has a flat base member 1 that includes left and right mounting holes 3 through which the base member 1 is bolted to a vehicle panel constituting an engine room of an automobile. The base member 1 is provided with an enter groove 9 which a striker 7 enters in closing of the hood 5, a latch 11 to be engaged with the striker 7 on one side of the enter groove 9, and a locking lever 13 for constraining the latch 11 in engagement on the other side of the enter groove 9.

The latch 11 and the locking lever 13 are disposed between the base member 1 and a reinforcing plate 15 provided separately. The latch 11 has a U-shaped distal end portion and is mounted to a back side (an upper side that is on the engine room 19 side in FIG. 3 or inside in FIG. 1) of the base member 1 and the reinforcing plate 15 by a latch shaft 17. The latch 11 can rotate between an engagement released position shown by a chain double-dashed line in FIG. 2 where the latch 11 is in a waiting state and an engaged position shown by a solid line where the latch 11 is engaged with the striker 7. The latch 11 is normally biased to the engagement released position (shown by a double-dashed line in FIG. 2) by a first biasing spring 21.

An end of the first biasing spring 21 is lockingly engaged to a latch 11 side and the other end is lockingly engaged to a base member 1 side.

The locking lever 13 is mounted for rotation to the back side (the upper side that is on the engine room 19 side in FIG. 3) of the base member 1 and the reinforcing plate 15 by a lever shaft 23 and is normally biased to a constrained position (shown by a solid line in FIG. 2) by a second biasing spring 25. The locking lever 13 has a locking portion 13a formed of a recessed part of the locking portion 13*a*. The locking portion 13*a* engages with a pawl portion 11*a* of the latch 11 that has rotated to the engagement position, and constrains the latch 11 at the engagement position. An end portion of the locking lever 13 is connected to an operating portion that is on an outside of the drawing through a cable 27. When the locking lever 13 is pulled through the cable 27 in a direction shown by an arrow X1, engagement of the locking portion 13*a* and the pawl portion 11*a* with each other is released.

An end of the second biasing spring 25 is locked to the locking lever 13 side and the other end is locked to the base member 1 side.

On the other hand, the substantially U-shaped reinforcing plate 15 in a plane configuration has first and second projecting bodies 29 and 31, or projection, extending inward, namely, toward the engine room 19 side and facing each other on the latch shaft 17 side. A detecting switch 33 is supported at two points, namely, fixed to and supported by the first and second projecting bodies 29 and 31.

Figure 4:
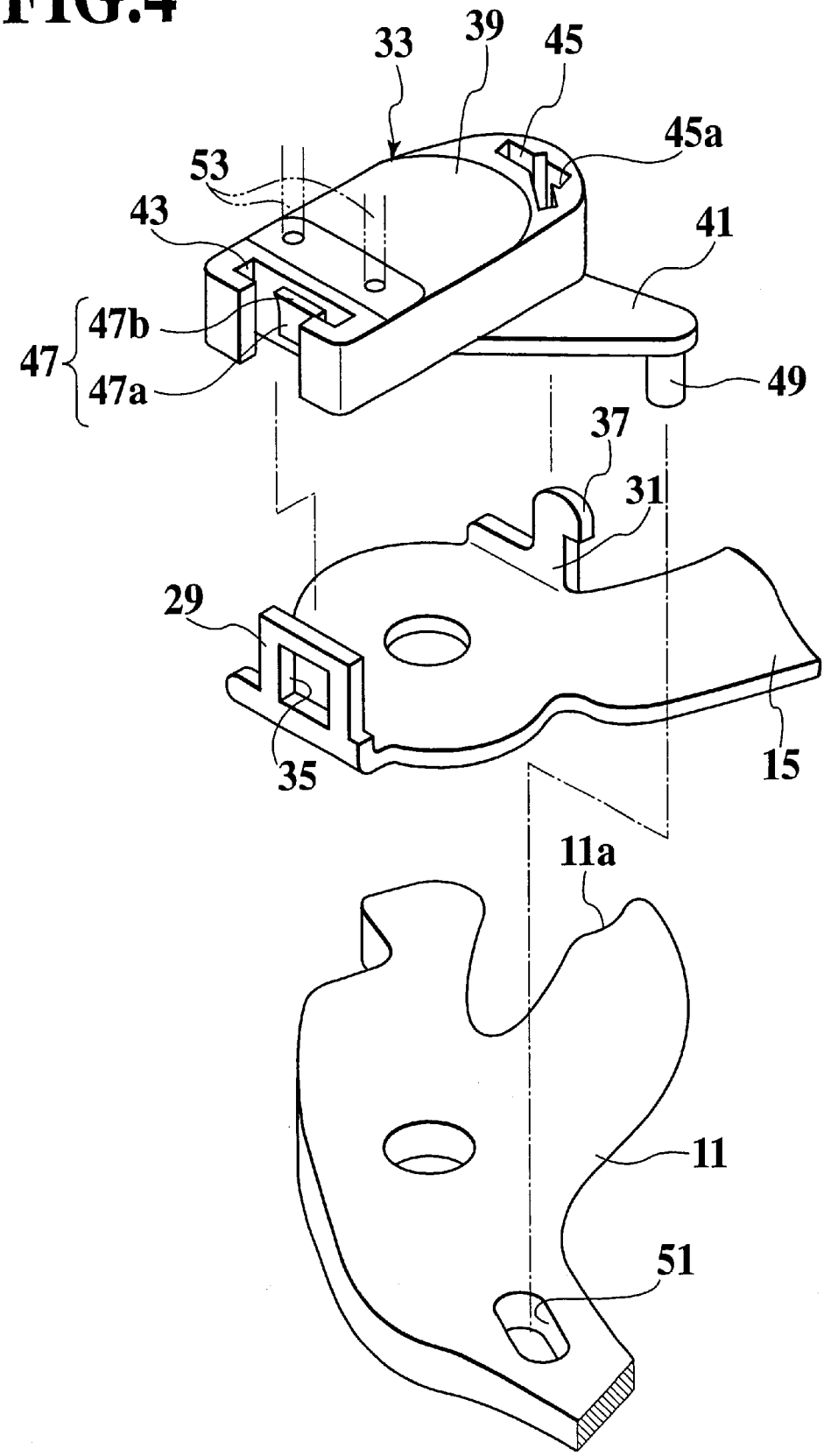
FIG. 4 is an exploded perspective view of a detecting switch, a reinforcing plate, and a latch.

As shown in FIG. 4, the first projecting body 29 is formed into a plate-shaped projecting piece which is formed integrally with the reinforcing plate 15 by bending and has a rectangular opening 35. The second projecting body 31 is formed into a plate-shaped projecting piece formed integrally with the reinforcing plate 15 by bending and having a hook portion 37. The hook portion 37 has a larger width than the projecting piece and is to engage in a dropping direction.

The detecting switch 33 has a switch main body 39 and a detecting lever 41 projecting sideways from a bottom portion. The switch main body 39 is provided with a first fitting portion 43 and second fitting portions 45 to be respectively fitted with the first and second projecting bodies 29 and 31.

The first fitting portion 43 is made of synthetic resin and has a C shape in section with one side thereof open. A fitting section of the first fitting portion 43 has the same shape as a thickness section of the first projecting body 29 and a size of the fitting section may be slightly enlarged or reduced. The first fitting portion 43 has a dropping-preventing stopper 47 to be detachably engaged with the opening 35 of the first projecting body 29.

The dropping preventing stopper 47 is formed of a tapered face 47*a* for guiding a distal end side of the first mounting engagement projecting body 29 outward in insertion of the projecting body 29 and an engagement stepped face 47*b* with which an opening end edge of the opening 35 engages and which constrains movement in the dropping direction after the opening end edge passes over the tapered face 47*a*.

The second fitting portions 45 are made of synthetic resin material and each the portion 45 is an elongated hole having the same sectional area as a thickness section of the second projecting body 31. Two elongated hole-shaped second fitting portions 45 are provided to be compatible with left-hand drive and to allow the second projecting body 31 with the hook portion 37 in either orientation to be assembled and the second fitting portions 45 partially overlaps each other.

The detecting lever 41 rotates synchronously with movement of the latch 11 to detect a movement amount of the latch 11 and is disposed between the reinforcing plate 15 and the switch main body 39.

The detecting lever 41 is provided with a lever pin 49. The lever pin 49 has such a shape as to be engaged with an engagement hole 51 provided to the latch 11 and to obtain movement synchronous with the latch 11. As a result, a detecting signal is transmitted to an alarm device through a controlling portion on an outside of the drawing through lead wires 53 extending from the switch main body 39 toward the engine room 19.

The detecting switch 33 and the lead wires 53 are positioned in a back area of the base member 1, inside in FIG. 1, and can not be directly seen from outside.

The above-mentioned controlling portion on the outside of the drawing is formed not to transmit an actuating signal to the alarm device when two conditions that the latch 11 has moved and that the cable 27 has been operated are satisfied. While, the controlling portion is to transmit the actuating signal to the alarm device only when the cable 27 has not been operated and only the condition that the latch 11 has moved is satisfied.

In FIG. 2, an auxiliary latch 55 provisionally supports a hood 5 that has been pushed up to such an extent that a hand can be inserted under the hood 5 when locking has been released. Provisional support by the latch 55 is to be released by operating the latch lever 57.

In the lock device of the automobile openable body with the above structure, the first and second fitting portions 43 and 45 of the switch main body 39 is fitted with the first and second projecting bodies 29 and 31, and the detecting switch 33 may be easily mounted without being influenced by the respective auxiliaries disposed in the engine room 19

In this mounting, a size of the first fitting portion 43 is enlarged in fitting of the first mounting engagement projecting body 29 that gets on the tapered face 47*a* of the dropping preventing stopper 47. When the projecting body 29 gets over the tapered face 47*a,* the opening end edge of the opening 35 engages with the engagement stepped face 47*b* to obtain a reliable fitted state in which movement in the dropping direction is constrained.

Figure 5:
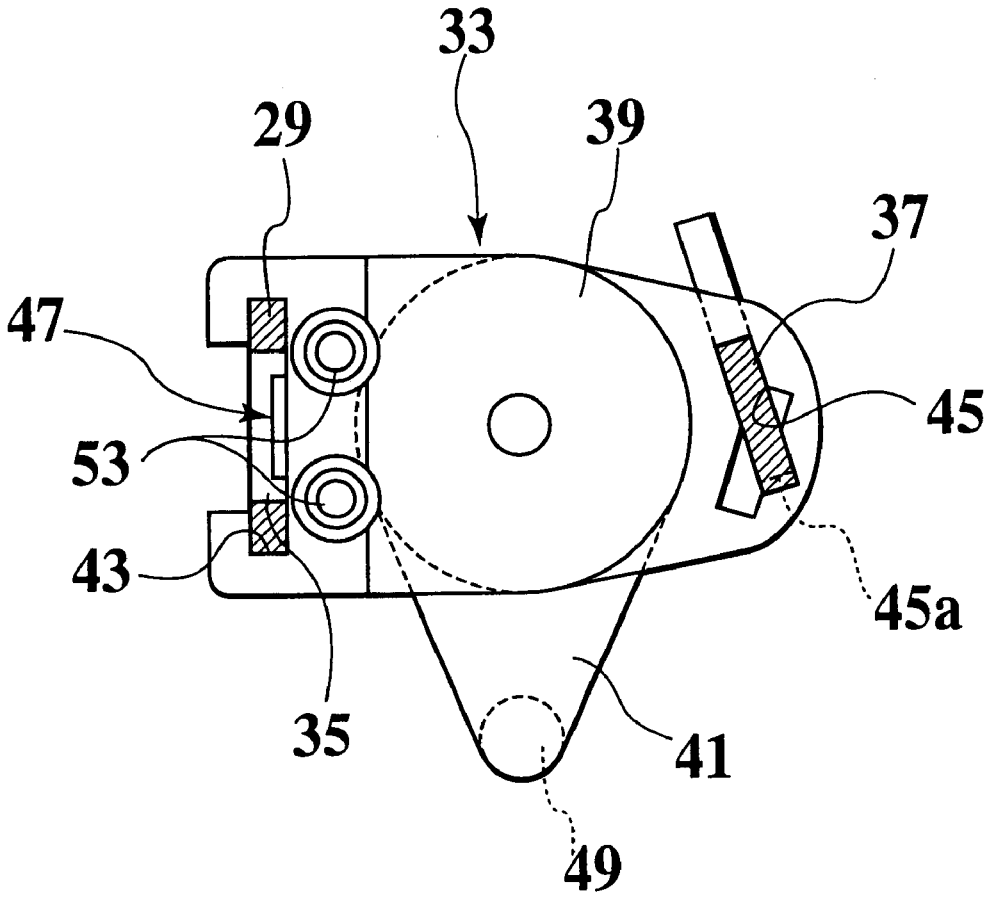
FIG. 5 is a sectional explanatory view showing a mounting state in which mounting engagement projecting bodies are fitted into fitting holes of the detecting switch.

When the hook portion 37 forcedly enters the fitting portions 45, as shown in FIG. 5, a size of the second fitting portions 45 is slightly enlarged because of synthetic resin and a special hole shape of the second fitting portion 45, and the hook portion 37 of the second mounting engagement projecting body 31 can pass through the second fitting portions 45. At this time, the hook portion 37 engages with an edge 45*a* of the fitting portions 45 to provide a reliable fitted state in which movement in the dropping direction is constrained. In addition, the detecting switch is supported at two points, and a stable supported state is ensured.

On the other hand, the lever pin 49 can reliably obtain movement of the detecting lever 41 of the detecting switch 33 synchronous with the latch 11. The lead wires 53 and the detecting switch 33 are in the back area of the base member 1, and are hidden not to be directly seen from outside. Therefore, even when the device is attacked by fraudulent means, the lead wires 53 for transmitting the signal to the alarm device cannot be cut.

Furthermore, the latch 11 and the locking lever 13 are held between the base member 1 and the reinforcing plate 15, and strength and rigidity of the entire device are improved.

Next, usage of the lock device 100 will be described. In order to lock the hood 5 of the automobile, the hood 5 is moved down and the striker 7 is caused to enter the enter groove 9. At this time, the striker 7 enters the U-shaped portion of the latch 11 and pushes the latch 11 downward. The latch 11 is rotated clockwise about the latch shaft 17 and the pawl portion 11*a* is lockingly engaged to the locking portion 13*a* of the locking lever 13. The detecting lever 41 rotates together with the latch 11. Here, the latch 11 is biased by the first biasing spring 21 to return to its original position and the locking lever 13 is biased by the second biasing spring 25 toward the latch 11. Therefore, the latch 11 is not detached from the locking lever 13. In this manner, the hood 5 of the automobile is locked.

Even when someone tries to operate the detecting switch 33 or the lead wires 53, the detecting switch 33 and the like are on the back side of the base member 1, namely, on the engine room side and are not broken nor cut.

Next, the locked state of the hood 5 is released as follows. First, the lever (not shown) is operated and the cable 27 is pulled in the direction shown by the arrow X1. At this time, the cable 27 rotates the locking lever 13 counterclockwise about the lever shaft 23 against the biasing spring 25. The pawl portion 11*a* of the latch 11 is detached from the locking portion 13*a* and the latch 11 is rotated to its original position by the biasing spring 21. The striker 7 can move freely.

Next, the latch lever 57 is rotated clockwise and the hood 5 and the auxiliary latch 55 are released. Then, the hood 5 is lifted together with the striker 7.

What is claimed is:

1. A lock device for an openable member of an automobile, comprising:

a latch interposed between a base member and a reinforcing plate, the latch being configured to rotate between an engagement position and engage with a striker at the engagement position when closing an openable member; and a locking lever configured to lock with the latch at the engagement position, wherein the latch and the locking lever each are mounted on a back side of the base member with the reinforcing plate;

wherein the reinforcing plate comprises first and second projections projecting inwardly therefrom and disposed on the latch;

the first and second projections support and fix a detecting switch for detecting movement of the latch, the first and second projections being fitted in first and second mating portions provided to opposite ends of a switch body of the detecting switch; and wherein the detecting switch comprises a detecting lever supported rotatably to the switch body, and the detecting lever engages with the latch for rotating coaxially with the latch.

2. A lock device cited in claim 1, wherein at least one of the first and second projections is formed as a plate-like projecting piece which is formed integrally out of a reinforcing plate to be bent and has an opening, and a first mating portion has an enlargable C-shape in which one side to be fitted with the projecting piece is open, and has a stopper for preventing dropping which detachably engages with the opening.

3. A lock device cited in claim 1, wherein one of the first and second projections is formed integrally out of the reinforcing plate to be bent and has a hook portion, and a second mating portion has a resiliently deformable hole-shape in which two elongated holes with a width size smaller than that of the hook portion of the projecting piece partially overlap.

4. A lock device cited in claim 1, wherein the detecting switch is positioned in a back area of the base member with a wire extending from the detecting switch, and has an arrangement structure which makes the detecting switch not be seen from outside.

5. A lock device cited in claim 1, wherein the detecting lever is arranged between the switch body and the reinforcing plate.

6. A lock device for an openable member of an automobile comprising:

a rotary latch configured to engage with a striker of an openable member;

a detecting switch mounted on the latch, the detecting switch comprising a detecting member configured to rotate coaxially with the latch for detecting the latch in angular displacement; and a reinforcing member provided between the latch and the detecting switch, the reinforcing member comprising first and second locking members each extending therefrom toward the detecting switch, the first and second locking members being each locked with the detecting switch.

7. A lock device cited in claim 6, further comprising:

a base member opposed to the detecting switch relative to the latch, the base member having a groove guiding the striker.

wherein the latch engages with the striker to be guided by the groove.

8. A lock device cited in claim 6, further comprising:

a locking lever configured to lock with the latch engaged with the striker, wherein the reinforcing member is opposed to the base member relative to the locking lever.

9. A lock device cited in claim 6, wherein a first locking member has a first opening, the detecting switch comprises a first mating portion locked with the first locking member, and the first mating portion comprises an enlargable holding portion having a second opening for inserting the first locking member therein; and a stopper in the second opening, being locked with the first opening.

10. A lock device cited in claim 6, wherein the detecting switch comprises a second mating portion, a second locking member comprises a hook locked with the second mating portion, and the second mating portion comprises a pair of resiliently deformable elongated holes partially overlapped each other, the hook is inserted in and locked with the pair of holes.

11. A lock device cited in claim 7, wherein the detecting switch comprises a wire extending inwardly away from the base member.

* * * * *